US006401687B1

(12) United States Patent
Kozlov et al.

(10) Patent No.: US 6,401,687 B1
(45) Date of Patent: Jun. 11, 2002

(54) AXIAL ROTARY ENGINE

(75) Inventors: Georgy Leonidovich Kozlov; Petr Anarolievich Regel, both of St.Petersburg (RU)

(73) Assignee: Arktur-Trading GmbH (DE)

( * ) Notice: Subject to any disclaimer, the term of this patent is extended or adjusted under 35 U.S.C. 154(b) by 0 days.

(21) Appl. No.: 09/857,894

(22) PCT Filed: Dec. 10, 1999

(86) PCT No.: PCT/RU99/00479

§ 371 (c)(1),
(2), (4) Date: Jun. 11, 2001

(87) PCT Pub. No.: WO00/36278

PCT Pub. Date: Jun. 22, 2000

(30) Foreign Application Priority Data

Dec. 11, 1998 (RU) ..... 98123144

(51) Int. Cl.[7] ..... F02B 53/00

(52) U.S. Cl. ..... 123/243; 123/245; 123/247; 418/219

(58) Field of Search ..... 123/243, 245, 123/247; 418/219

(56) References Cited

U.S. PATENT DOCUMENTS

| | | | | | |
|---|---|---|---|---|---|
| 268,195 | A | * | 11/1882 | Davis | 418/219 |
| 1,686,767 | A | * | 10/1928 | Saxon | 123/243 |
| 2,688,385 | A | * | 9/1954 | McLaughlin et al. | 418/219 |
| 3,799,710 | A | * | 3/1974 | Jacobs | 418/219 |
| 3,886,910 | A | * | 6/1975 | Vrooman | 418/219 |
| 4,004,556 | A | * | 1/1977 | Pfeiffer | 123/243 |
| 5,429,084 | A | * | 7/1995 | Cherry et al. | 123/243 |
| 5,509,793 | A | * | 4/1996 | Cherry et al. | 123/243 |

FOREIGN PATENT DOCUMENTS

| | | |
|---|---|---|
| DE | 2 301 666 | 1/1973 |
| DE | 3218 601 A1 | 5/1982 |
| GB | 2183732 A | 6/1987 |
| RU | 2018695 | 3/1991 |
| SU | 1188336 A | 1/1983 |
| WO | WO 97/43518 | 11/1997 |

* cited by examiner

*Primary Examiner*—Thomas Denion
*Assistant Examiner*—Thai-Ba Trieu
(74) *Attorney, Agent, or Firm*—McKee, Voorhees & Sease, P.L.C.

(57) ABSTRACT

The rotary axial engine comprises a housing 1 in which there is a wave-like annular channel 10 for a working medium and a rotor 5 is mounted, the peripheral portion of the rotor being in the channel 10. Slots are made in the peripheral portion of the rotor 5, and movable blades 8, which during rotation of the rotor 5 move along the wave-like channel 10, are mounted in the slots. The blades 8 have a form of flattened cylinders with tangential grooves 16 positioned diametrically opposite each other, and disk end portions positioned at both sides of the grooves 16. There are sealing elements 17, mounted with the possibility for movement along the perimeter of disk portions, in the grooves on the circumference of the disk portions. The slots of the rotor 5 have a form corresponding to a cross section of the blade 8 in a diametral plane perpendicular to the direction of the tangential grooves 16.

2 Claims, 3 Drawing Sheets

AXIAL ROTARY ENGINE

FIELD OF THE INVENTION

The invention relates to internal combustion engines, in particular, to rotary engines, and may be used in vehicles such as automobiles or airplanes, and in portable power plants.

BACKGROUND OF THE INVENTION

A rotary piston engine proposed by Wankel comprises a triangular rotor placed inside a cylindrical housing, the profile of which is made in accordance with an epitrochoid. The rotor is mounted so that it may rotate on an eccentric shaft and is rigidly connected to a movable gear wheel which interacts with a stationary gear wheel. The rotor with the movable gear wheel revolves around the stationary wheel so that its edges slide along the inner surface of the housing, cutting off the variable volumes of the chambers of a channel for passing the working medium, which is formed between the inner surface of the housing and the surface of the rotor. The housing is provided with ports for the supply of a fuel mixture and the discharge of exhaust gases and with a chamber connected to the channel, a sparkplug being mounted in the chamber. The engine does not have massive parts executing reciprocal movement, as a result of which the smoothness of the stroke is enhanced, the noise level and vibration reduced during operation.

However, such a construction has drawbacks related to the presence of gear wheels and an eccentric shaft, which reduce the reliability of operation.

A rotary engine is known in which the rotor is positioned axially (see WO 94/04794, IPC F 01 C 1/344, published Mar. 3, 1994). Such an engine has a housing, inside which a disk rotor with blades is secured on an axle of rotation, the blades being mounted in slots made in the peripheral part of the rotor. The housing consists of two massive covers connected to each other. A removable insert is mounted in an annular recess of each cover from the side of the rotor, the insert forming an annular channel for the passage of the working medium, in which the peripheral part of the rotor together with the blades is located. The blades have the form of rectangular plates, the short sides of which, facing the covers, have a radius curvature, and the slots of the rotor have the form of straight slits corresponding to the form of the cross section of the rectangular plates. The annular channel for passage of the working medium has in section a rectangular shape corresponding to the shape of the blades and is divided by the rotor disk into two parts equal in volume. In the direction along the axle of the rotor the channel bends wave-like in accordance with a periodical law, symmetrical relative to the middle section of the rotor, perpendicular to the axis of the rotor. The wave-like curve along which the channel is bent has a trapezoidal shape in development on a plane. The covers are provided with ports for the supply of air and outlet of exhaust gases, and also with a chamber connected to the channel, with a fuel-injection nozzle mounted in the chamber.

Such an engine has axial positioning of the disk rotor and is completely balanced, and therefore more reliable in operation. However, the complex system of stationary seals on the blade results in their nonuniform wear in the process of operation. The seals which are on the curves of a blade wear down significantly more rapidly than on the straight portions, which results in a loss of the air-tightness of the working chambers, and consequently to a drop of the power or even to a breakdown of the engine.

The object at the base of the invention is to enhance the reliability of operation of a rotary engine construction.

DISCLOSURE OF THE INVENTION

The stated object is achieved in that in a rotary axial engine comprising a housing consisting of two interconnected covers, a rotor secured on an axle, mounted between the covers and having guiding slots on a peripheral portion thereof, the slots being oriented in radial planes along the axle of the rotor, and blades mounted in the slots with the possibility for their reciprocal movement in a direction parallel to the axis of the rotor, wherein an annular recess is made on an inner surface of each cover of such a configuration that an annular channel for passage of a working medium is formed when the covers are connected, the annular channel having in a section passing through the axis of the rotor a shape corresponding to the shape of the blade and bending wavelike according to a periodic law symmetrically relative to the middle section of the rotor, perpendicular to the axis thereof, the blades are provided with sealing elements, the peripheral portion of the rotor with mounted blades is placed inside the annular channel, and each cover is provided with ports for the supply of air into the annular channel and for the discharge of exhaust gases, and also with a chamber connected to the annular channel, in which chamber a fuel-injection nozzle is mounted, in accordance with the invention, each blade has the form of a flattened cylinder, on the side surface of which there are two tangential grooves positioned diametrically opposite each other, the guiding slots of the rotor have a form corresponding to a cross section of the blade in a diametrical plane perpendicular to the direction of the tangential grooves. The annular channel is preferably made bending according to a sinusoid.

BEST MODES OF CARRYING OUT THE INVENTION

The invention is explained by drawing, in which.

Figure 1:
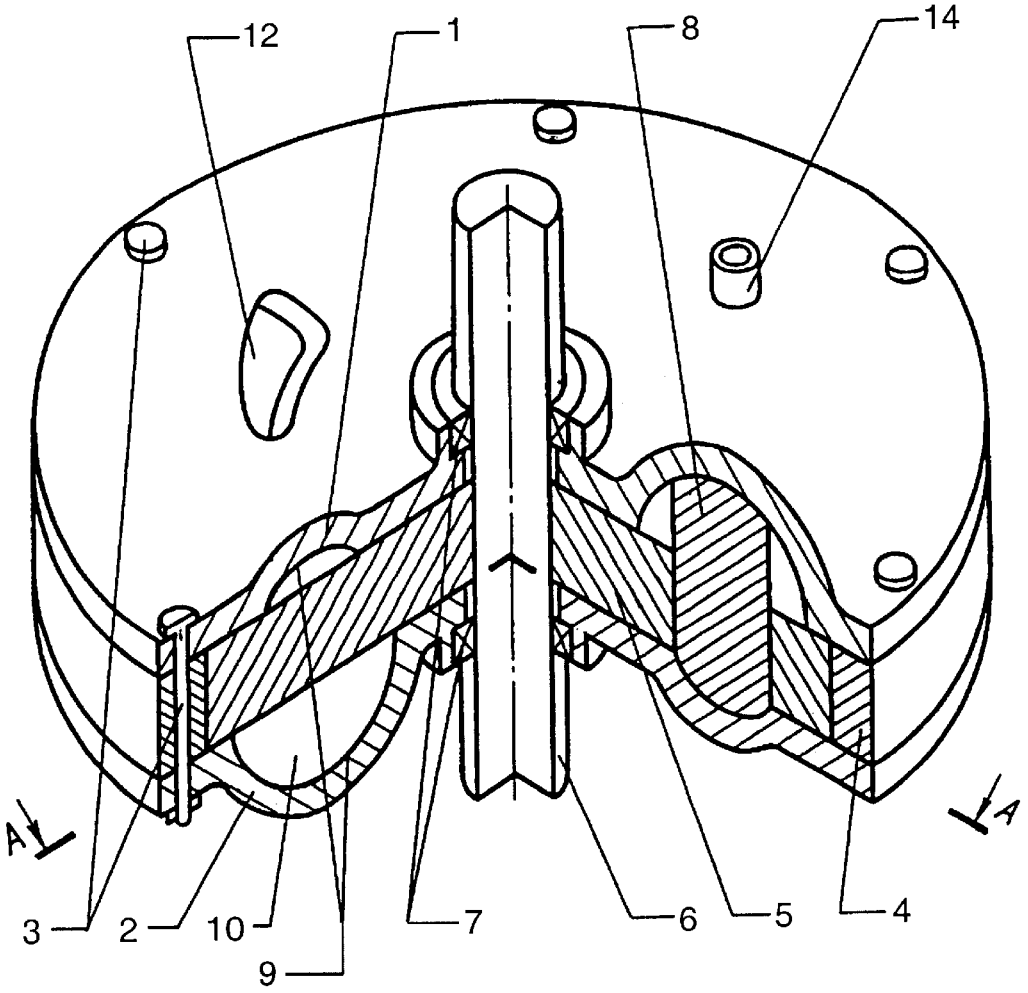
FIG. 1 shows a general isometric view of the engine.
Figure 2:
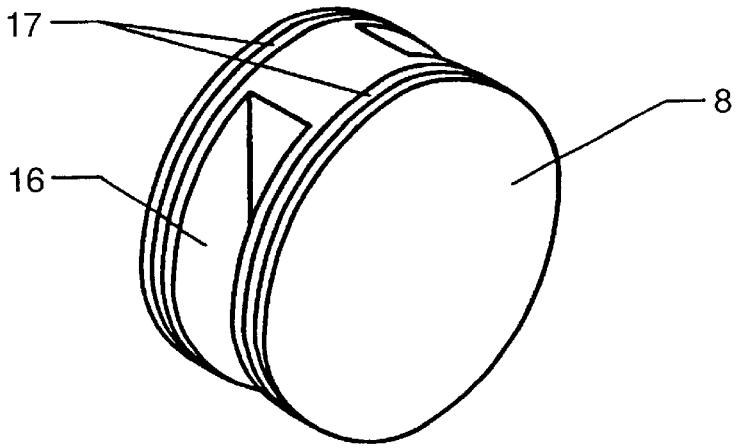
FIG. 2 shows an isometric view of a blade with sealing elements.
Figure 3:
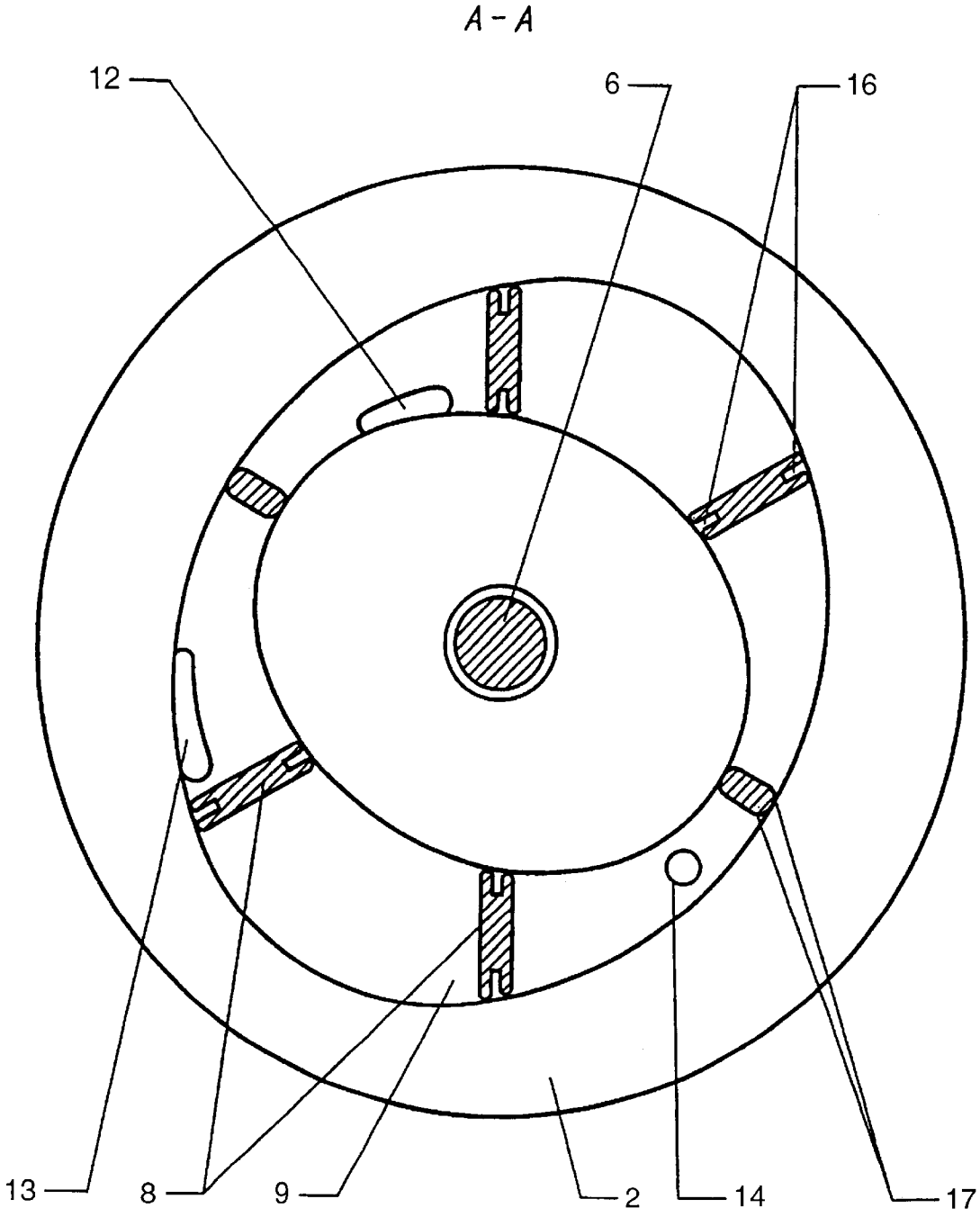
FIG. 3 shows a section A—A in FIG. 1.

The engine includes a housing consisting of an upper cover 1 and a lower cover 2, which are connected to each other by bolts 3 through a spacer 4. The rotor 5 is secured on an axle 6 between the covers 1 and 2 with the possibility of rotating in bearings 7. The rotor 5 has guiding slots on its peripheral portion, with blades 8 freely mounted in the slots. The covers 1 and 2 from the side facing the rotor 5 have annular recesses 9 which are made in such a manner that during the assembly of the covers into a single construction, an annular channel 10 is formed for the passage of a working medium, the channel being divided by the rotor 5, the peripheral portion of which, with the blades 8 mounted therein, is placed inside the annular channel 10. The annular channel 10 has in cross section, passing through the axle 6, the form of a circle with a diameter corresponding to the diameter of a blade 8. The annular channel 10 bends wavelike in accordance with a periodical law, preferably according to a sinusoid 11, symmetrically relative to the middle section of the rotor 5, which is perpendicular to the axle 6. In the covers 1 and 2, there are ports 12 for the inlet of air and ports 13 for the discharge of exhaust gases. In the body of each cover there are chambers 14 connected to the channel 10, in which chambers fuel-injection nozzles 15 are placed, and if necessary hot-bulb systems (not shown in the drawings).

The blade 8 has a form of a flattened cylinder, on the side surface of which two tangential grooves 16 are made, which are positioned diametrically opposite each other. The end face parts of the cylinder, which are positioned at both sides of the grooves 16, form disk portions of the blades 8. The sealing elements formed by the rings 17 are freely mounted in grooves made on the side surface of the disk portions of the blades 8.

The slots of the rotor 5 in which the blades 8 are mounted have a shape corresponding to a cross section of a blade 8 in its diametral plane perpendicular to a direction of the tangential grooves 16, i.e., a H-shaped form. Wherein, the disk portions of the blade 8 enter parallel portions of the slot, and its portion positioned between the grooves 16 and connecting the disk portions enters the portion of the slot connecting the aforesaid parallel portions.

Figure 4:
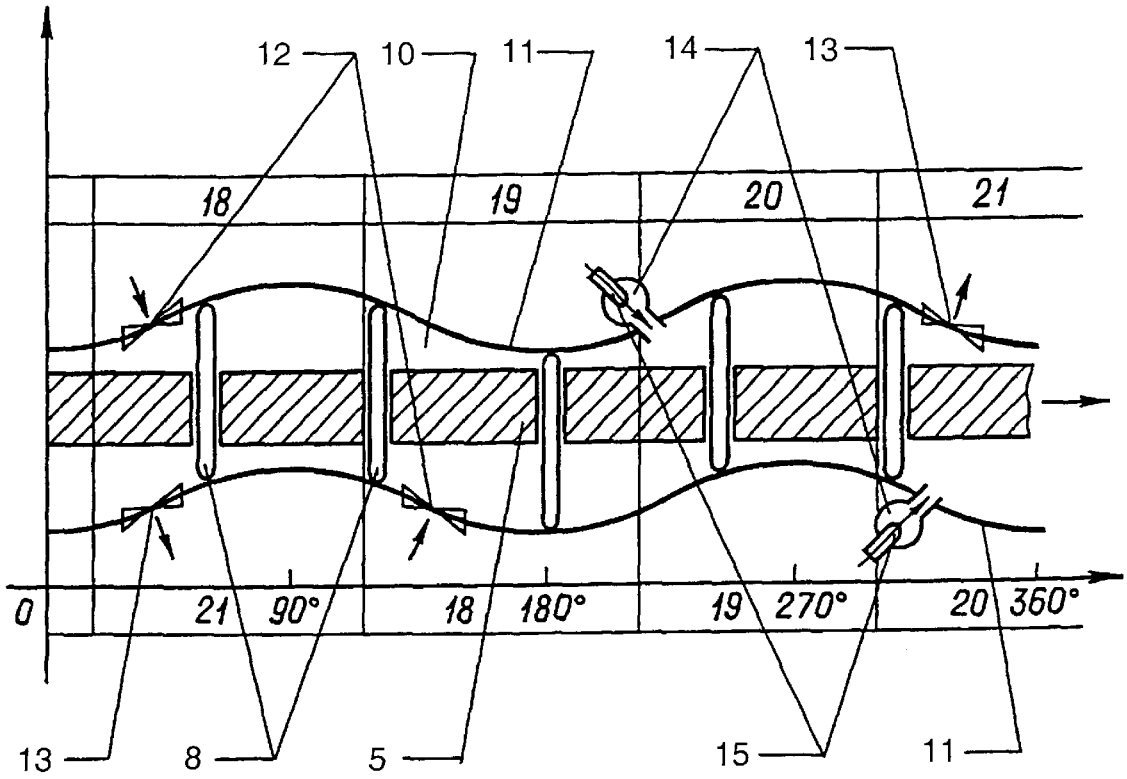
FIG. 4 shows a diagram of the working process of the engine in development on a plane of the annular section along the middle line of the channel 10.

The channel 10 is divided by the rotor 5 into two parts, each of which may conditionally be divided into zones: 18—air intake zone, 19—compression zone, 20—working stroke zone, 21—exhaust gases outlet zone. Wherein, each working zone of the upper part of the channel 10 is shifted in respect to a similar working zone of the lower part of the channel by a predetermined angle. In the case where the "sinusoid" of the channel 10 has 2 periods, as shown in FIG. 4, the shift angle is 90°. In engines with greater power, and consequently with a larger diameter of the rotor, it is advisable to increase the number of periods (bends) of the annular channel. In such a case the shift angle will be smaller.

The engine works in the following manner.

At the initial moment the starting mechanism brings the rotor 5 into rotation and the blades 8 begin to move along the channel 10 around the axle 6 together with the rotor 5. Wherewith, air through the port 12 is sucked or injected under pressure into the space between neighboring blades 8 which are in the zone 18. Then, after both neighboring blades have passed the port 12, the space between them is reduced and compression of the air takes place (zone 19). In the working stroke zone 20, fuel, which self-ignites at a high degree of compression or is ignited with the aid of a hot-bulb system, is fed from the chamber 14 through the nozzle 15 into the compressed air. The pressure of the expanding gases acts on the blades 8 and causes rotation of the rotor 5. The exhaust gases are discharged through the port 13 in the zone 21. Further, combustion is maintained by the continuous supply of fuel through the nozzle 15.

During operation of the engine, the blades 8 execute complex movement: reciprocal in the slots of the rotor 5 in a direction parallel to the axle 6 of the rotor and forward movement along the annular channel 10. Due to the grooves 16, a blade 8 cannot be displaced along the radius of the rotor 5 during its movement along the axle 6 of the rotor and is too strongly pressed against the wall of the channel 10, for example under the action of centrifugal forces, which could cause jamming of the blade.

Sealing the working chambers between the blades 8 is carried out with the rings 17. Due to the circular shape of the disk portions of the blades 8 and the free mounting of the rings 17 in the grooves of these portions, the rings 17 during movement of the blades slide along these grooves and turn, constantly changing position, which ensures their uniform wear and thus more reliable operation of the engine.

The sinusoidal shape of the channel 10, which is not obligatory, is optimum from the point of view of uniform operation of the engine and prevention of jamming of the blades in the channel during their movement, especially in the case of high frequency of rotor 5 rotation.

The claimed engine may operate in accordance with the described cycle using any liquid hydrocarbon fuel.

In order to achieve greater engine power, several concentric channels may be made in the covers, and several concentric rows of slots in the rotor, with a corresponding number of blades mounted therein.

What is claimed is:

1. A rotary axial engine comprising a housing consisting of two interconnected covers, a rotor secured on an axle, mounted between the covers and having guiding slots on a peripheral portion thereof, the slots being oriented in radial planes along the axle of the rotor, and blades mounted in the slots with the possibility for their reciprocal movement in a direction parallel to the axis of the rotor, wherein an annular recess is made on an inner surface of each cover of such a configuration that an annular channel for passage of a working medium is formed when the covers are connected, the annular channel having in a section passing through the axis of the rotor a shape corresponding to the shape of the blade and bending wavelike according to a periodic law symmetrically relative to the middle section of the rotor, perpendicular to the axis thereof, the blades are provided with sealing elements, the peripheral portion of the rotor with mounted blades is placed inside the annular channel, and each cover is provided with ports for the supply of air into the annular channel and for the discharge of exhaust gases, and also with a chamber connected to the annular channel, in which chamber a fuel-injection nozzle is mounted, characterized in that each blade 8 has a form of a flattened cylinder, on the side surface of which there are two tangential grooves 16 positioned diametrically opposite each other, the guiding slots of the rotor 5 have a form corresponding to a cross section of the blade 8 in a diametrical plane perpendicular to a direction of the tangential grooves 16, and the sealing elements 17 are mounted on a side surface of disk portions of the blade 8 for their free movement along the perimeter of the disk portions of the blade 8.

2. A rotary axial engine according to claim 1, characterized in that the annular channel 10 bends according to a sinusoid.

* * * * *